US010827904B2

(12) United States Patent
Dirnberger et al.

(10) Patent No.: US 10,827,904 B2
(45) Date of Patent: Nov. 10, 2020

(54) DOMESTIC ELECTRICAL APPLIANCE, IN PARTICULAR A DISHWASHING MACHINE

(71) Applicant: emz-Hanauer GmbH & Co. KGaA, Nabburg (DE)

(72) Inventors: Albert Dirnberger, Neunburg v. W. (DE); Matthias Bauer, Schmidgaden (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 376 days.

(21) Appl. No.: 15/631,042

(22) Filed: Jun. 23, 2017

(65) Prior Publication Data

US 2018/0000312 A1 Jan. 4, 2018

(30) Foreign Application Priority Data

Jul. 1, 2016 (DE) ..... 10 2016 008 044

(51) Int. Cl.
*A47L 15/42* (2006.01)
*E05B 15/00* (2006.01)
(Continued)

(52) U.S. Cl.
CPC ..... *A47L 15/4259* (2013.01); *E05B 15/0006* (2013.01); *E05B 15/0295* (2013.01);
(Continued)

(58) Field of Classification Search
CPC ..... Y10T 292/1082; Y10T 292/1043; Y10T 292/1047; A47L 15/4259; E05B 15/0006;
(Continued)

(56) References Cited

U.S. PATENT DOCUMENTS 1,147,921 A * 7/1915 Mayer et al. ..... E05B 47/0002 292/71
2,558,233 A * 6/1951 Burke ..... E05B 65/0042 292/332
(Continued)

FOREIGN PATENT DOCUMENTS

CN 203252621 U 10/2013
DE 102006037494 A1 2/2008
WO 2015066580 A2 5/2015

OTHER PUBLICATIONS

German Office Action in co-pending application DE 10 2016 008 044.2, dated Mar. 16, 2017.
(Continued)

*Primary Examiner* — Kristina R Fulton
*Assistant Examiner* — Faria F Ahmad
(74) *Attorney, Agent, or Firm* — Robert R. Deleault, Esq.; Sarita L. Pickett, Esq.; Mesmer & Deleault, PLLC

(57) ABSTRACT

A domestic electrical appliance, in particular a dishwashing machine, includes a main appliance body having a product treatment chamber, a door mounted on the main appliance body so as to be pivotable about a horizontal pivot axis close to the floor for closing an access opening to the product treatment chamber and a locking device having a locking assembly arranged on the main appliance body and a closing pin arranged on the door. The locking assembly has a latch movable between a release position and a latching position where the latch engages behind the closing pin to hold the door closed and releases the closing pin to open the door. The latch performs a rotational movement along a horizontal plane as it moves between the release position and the latching position, the closing pin being oriented vertically when the door is closed.

9 Claims, 7 Drawing Sheets

(51) Int. Cl.

| | |
|---|---|
| ***E05B 17/00*** | (2006.01) |
| ***E05C 19/02*** | (2006.01) |
| ***E05B 15/02*** | (2006.01) |
| ***E05C 5/00*** | (2006.01) |
| ***E05B 47/00*** | (2006.01) |
| ***E05B 15/04*** | (2006.01) |

(52) U.S. Cl.
CPC ..... *E05B 17/0025* (2013.01); *E05C 5/00* (2013.01); *E05C 19/02* (2013.01); *E05C 19/024* (2013.01); *E05B 2015/0493* (2013.01); *E05B 2047/0067* (2013.01); *E05B 2047/0069* (2013.01); *E05C 2005/005* (2013.01); *Y10S 292/69* (2013.01); *Y10T 292/1043* (2015.04); *Y10T 292/1047* (2015.04); *Y10T 292/1082* (2015.04)

(58) Field of Classification Search
CPC ..... E05B 15/0295; E05B 17/0025; E05B 2015/0493; E05B 2047/0067; E05B 2047/0069; E05C 5/00; E05C 19/02; E05C 19/024; E05C 2005/005; Y10S 292/69

See application file for complete search history.

(56) References Cited

U.S. PATENT DOCUMENTS

| | | | | |
|---|---|---|---|---|
| 2,777,721 | A * | 1/1957 | Burke | E05B 65/0046 292/332 |
| 2,833,578 | A * | 5/1958 | Burke | E05C 19/024 292/71 |
| 2,937,541 | A * | 5/1960 | Barlow | E05C 3/24 74/532 |
| 3,065,986 | A * | 11/1962 | Barker | E05C 9/042 292/332 |
| 4,163,443 | A * | 8/1979 | Peterson | E05C 5/00 126/197 |
| 7,032,939 | B2 * | 4/2006 | Magnusson | E05B 63/20 292/121 |
| 7,690,700 | B2 | 4/2010 | Neumann | |
| 8,733,802 | B2 * | 5/2014 | Promutico | D06F 37/28 292/57 |
| 9,370,294 | B2 * | 6/2016 | Osvatic | E06B 5/006 |
| 9,995,067 | B2 * | 6/2018 | Promutico | A47L 15/4259 |
| 10,240,372 | B2 * | 3/2019 | Dirnberger | E05B 47/0603 |
| 10,590,587 | B2 * | 3/2020 | Finney | D06F 37/42 |
| 2011/0265271 | A1 * | 11/2011 | Kim | D06F 39/14 8/137 |
| 2015/0238065 | A1 | 8/2015 | Osvatic et al. | |

OTHER PUBLICATIONS

CN Office Action with English translation in co-pending application CN 201710530434.6, dated Jul. 29, 2019.

* cited by examiner

DOMESTIC ELECTRICAL APPLIANCE, IN PARTICULAR A DISHWASHING MACHINE

BACKGROUND OF THE INVENTION

1. Field of the Invention

The present invention relates generally to a domestic electrical appliance, in particular a dishwashing machine.

2. Description of the Prior Art

A dishwashing machine typically has a main appliance body in which a product treatment chamber (washing chamber) is formed. A door is mounted on the main appliance body so as to be pivotable about a horizontal pivot axis that is close to the floor; the door serves to close an access opening to the product treatment chamber. During operation of the dishwashing machine, the door should be securely locked so that the hot washing liquid used in the washing chamber to clean the dishes does not escape from the machine and possibly endanger people standing in the vicinity. Dishwashing machines are therefore generally equipped with a locking device in order to be able to hold the door closed.

A conventional locking device for a dishwashing machine is disclosed in DE 10 2006 037 494 A1. In this conventional locking device, a depression is provided in an upper narrow side of the door (at the top when the door is upright, that is to say when the door is closed), into which recess a main slider arranged on the main appliance body engages with a protruding latching nose as the door closes. The engagement of the latching nose into the depression in the door holds the door closed.

SUMMARY OF THE INVENTION

By contrast, the present invention provides a domestic electrical appliance, in particular a dishwashing machine, comprising a main appliance body having a product treatment chamber, a door mounted on the main appliance body so as to be pivotable about a horizontal pivot axis that is close to the floor, for closing an access opening to the product treatment chamber, and a locking device having a locking assembly arranged on the main appliance body and a closing pin arranged on the door. The locking assembly comprises a latch which is arranged to be movable between a release position and a latching position, which latch, in the latching position, engages behind the closing pin in order to hold the door closed and, in the release position, releases the closing pin to open the door. As it moves between the release position and the latching position, the latch performs a rotational movement along a horizontal plane, and the closing pin is oriented vertically when the door is closed.

In some embodiments, the latch has a latch mouth delimited by two jaws, wherein the closing pin comes into contact with a first of the jaws as the door closes and thereby initiates a movement of the latch from the release position into the latching position. In the course of this movement of the latch, the second of the jaws of the latch moves behind the closing pin. In other embodiments, the latch has a latching system which moves behind the closing pin as the latch moves from the release position into the latching position, comparable to the function of the second jaw in the embodiments mentioned hereinbefore having a latch mouth. However, in these other embodiments, the movement of the latch from the release position into the latching position is initiated not by the closing pin striking the latch itself, but by a system (closing pin or another structure) arranged on the door striking a control member which is separate from the latch and is arranged to be movable relative thereto. For an example of such a control member, reference may be made to the control lever 52 shown in FIG. 3 of DE 10 2006 037 494 A1.

In the context of mass production, mounting tolerances on the one hand of the closing pin on the door and on the other hand of the door relative to the main appliance body cannot be ruled out. Horizontal-lateral mounting tolerances, in particular, can limit the correct operation of the locking device. Lateral here means a sideways direction from the perspective of a user who is standing in front of the dishwashing machine and looking at the (closed) door head-on. From the perspective of this user, lateral accordingly means a direction to the right or left. In order to ensure reliable operation of the locking device despite the mentioned horizontal-lateral mounting tolerances, there is formed on the locking assembly in some embodiments an aligning system for the mutual horizontal-lateral alignment of the closing pin and the latch, which aligning system cooperates with the closing pin as the door closes.

In some embodiments, the aligning system comprises a guide slot which the closing pin enters as the door closes. In the guide slot, the closing pin can be substantially free of horizontal-lateral movement play. In order to ensure that the closing pin engages reliably in the guide slot, an entry funnel can be arranged in front of the guide slot in the region of one of its slot ends closer to the closing pin. The entry funnel has a centring function, in order to centre the closing pin relative to the guide slot.

In some embodiments, it can be provided that the closing pin is mounted on the door with horizontal-lateral movement play. In these embodiments, the cooperation of the closing pin and the aligning system has the result that the closing pin assumes a defined lateral position relative to the latch (which is in the release position). In other embodiments, on the other hand, the latch and the aligning system are arranged for joint movement with a horizontal-lateral movement component. In the latter embodiments, the cooperation of the closing pin with the aligning system as the door closes effects a displacement of the aligning system and—together therewith—a displacement of the latch until the latch (which is in its release position) is situated in a defined position relative to the closing pin in which correct operation of the locking device is ensured.

The latch and the aligning system can be combined in a lock module which is mounted in a lock housing of the locking assembly with play movability along a horizontal plane. The play movability of the lock module can include rotational movability about an axis of rotation that is fixed relative to the lock housing, or linear movability relative to the lock housing.

In some embodiments, the play movability of the lock module is intended to compensate for horizontal-lateral position tolerances of the closing pin of at least ±1.5 mm or at least ±2 mm or at least ±2.5 mm or at least ±3 mm.

In addition to the latch and the aligning system, a spring arrangement for spring-biasing the latch or/and an electric switch, in particular a switch that responds to the closing and opening of the door, can be contained in the lock module.

According to a further aspect, the present invention provides a domestic electrical appliance, in particular a dishwashing machine, comprising a main appliance body having a product treatment chamber, a door for closing an access opening to the product treatment chamber, and a locking device having a locking assembly and having a closing body. The locking assembly is arranged on one of the two appliance components, the main appliance body and the door, while the closing body is arranged on the other of the two appliance components. The locking assembly comprises a latch which is arranged to be movable between a release position and a latching position, which latch, in the latching position, engages behind the closing body in order to hold the door closed and, in the release position, releases the closing body to open the door. There is additionally formed on the locking assembly an aligning system for the mutual alignment of the closing body and the latch, which aligning system cooperates with the closing body as the door is closed, wherein the latch and the aligning system are combined in a lock module which is mounted with play movability relative to a lock housing of the locking assembly.

The invention will be described in greater detail below with reference to the accompanying drawings.

DETAILED DESCRIPTION OF THE PREFERRED EMBODIMENT

Figure 1:
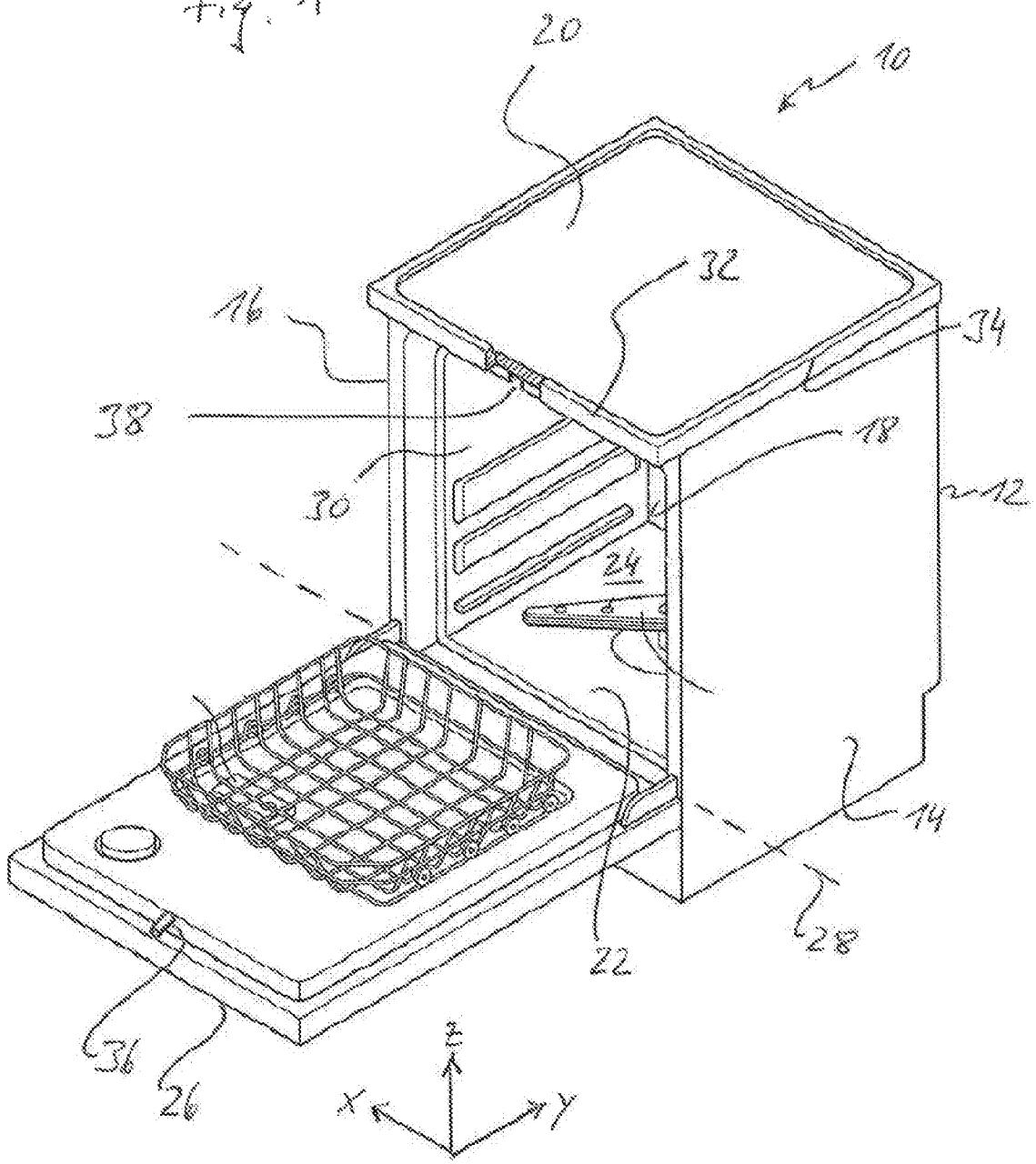
FIG. 1 is a perspective view of an example of a dishwashing machine.

Reference will first be made to FIG. 1. The dishwashing machine shown therein is generally designated 10. It comprises a main machine body 12 in which there is formed a washing chamber 24 delimited between two opposing side walls 14, 16, a back wall 18, a top wall 20 and a bottom wall 22. A door 26 is mounted on the main machine body 12 so as to be pivotable about a horizontal pivot axis that is close to the floor, indicated by a broken line at 28. The door serves to close an access opening 30 to the washing chamber 24.

A rectangular xyz coordinate system, the z-axis of which points in the vertical direction and the x-axis and y-axis of which span a horizontal plane, is also marked in FIG. 1. When the dishwashing machine 10 is positioned correctly, the door 26, when closed, lies in a vertical plane. The x-axis of the xyz coordinate system extends parallel to a front edge 32 of the main machine body 12 running from one side wall 14 to the other side wall 16 and defines a horizontal-lateral direction (or width direction) of the dishwashing machine 10. The y-axis extends parallel to a horizontal side edge 34, which runs from the front to the back of the main machine body 12, and defines a depth direction of the dishwashing machine 10.

Mounted on the door 26 is a closing pin 36 which, as the door 26 closes, cooperates with a locking assembly (not shown in FIG. 1) arranged on the main machine body 12 in order to hold the door 26 closed. The closing pin 36, which is shown only diagrammatically in FIG. 1, is so mounted on the door 26 that it is oriented with its pin longitudinal direction vertically, that is to say, in the direction of the z-axis, when the door is closed. By contrast, when the door is fully open (when the door—as shown in FIG. 1—is lying in a horizontal plane), the closing pin 36 is oriented horizontally, its pin longitudinal direction running along the y-axis.

In the top wall 20 of the main machine body 12 there is formed a cutout 38 which is open at the bottom and which the closing pin 36 enters as the door 26 closes. Behind the cutout 38 is the mentioned locking assembly.

In order to describe a first embodiment of a locking device with which the dishwashing machine of FIG. 1 can be provided, reference will now be made to FIGS. 2*a* to 2*g*. The locking device is generally designated 40. It comprises, in addition to the closing pin 36 mounted on the dishwasher door 26, a locking assembly 42 which comprises a lock housing 44 with which the locking assembly 42 can be fixed to the main machine body 12 of the dishwashing machine 10 in a manner not shown in greater detail (for example by means of one or more screw connections). Accommodated in the lock housing 44 is a plurality of components, including a latch 46, which in the example shown forms a latch mouth 52 delimited between two jaws 48, 50. As the dishwasher door 26 closes, the closing pin 36 enters the latch mouth 52 of the latch 46, whereby it first passes the first (from the point of view of the closing pin 36) latch jaw 48 unhindered and then comes into contact with the jaw 50 situated behind it (in the y-direction). The impact of the closing pin 36 against the jaw 50 initiates an at least partially rotational movement of the latch 46 in a horizontal plane, in the course of which the jaw 48 engages behind the closing pin 36 so that the closing pin 36 is caught between the jaws 48, 50. This caught state of the closing pin 36 is shown in FIGS. 2*d* and 2*e*. The position of the latch 46 according to FIGS. 2*a*, 2*b* (that is to say, when the door is open, or not yet closed) is here referred to as the release position, and the position of the latch 46 according to FIGS. 2*d*, 2*e* (that is to say when the door is closed) is referred to as the latching position. Conversely, as the door opens, the latch 46 moves from its latching position according to FIGS. 2*d*, 2*e* into the release position according to FIGS. 2*a*, 2*b*. The corresponding movement of the latch 46 is initiated by the user pulling the door 26 of the dishwashing machine 10 and thereby pressing the closing pin 36 against the jaw 48 of the latch 46.

The latch 46 is biased by a spring element 54, which in the example shown is in the form of a torsion spring (leg spring). The torsion spring 54 effects bistable biasing of the latch 46 into each of the two positions of the latch 46 (release position, latching position). In order to transfer the latch 46 from one position into the other position, a point of greatest spring tension of the torsion spring 54 must be overcome in each case; after this point has been overcome, the torsion spring 54 assists with the further movement of the latch 46 into the respective other position. It will be appreciated that, instead of a spring element with bistable action, it is possible to use a spring element with monostable action, which biases the latch 46 only in the direction of one of its two positions, in particular, the latching position. Such a spring element with monostable action is provided in the second embodiment, which will be described below with reference to FIGS. 3*a* to 3*d*.

The latch 46 and the torsion spring 54 are part of a lock module 56 which is accommodated inside the lock housing 44 and is guided therein with play movability in the horizontal-lateral direction, that is to say in the direction of the x-axis. The lock module 56 comprises a plate body (compensating plate) 58, on which the latch 46 and the torsion spring 54 are mounted. The plate body 58 has a bearing recess 60 in which a bearing pin 62 of the latch 46 engages. In the example shown, the bearing recess 60 is in the form of a slot extending in the direction of the x-axis, which permits displacement of the latch 46 relative to the plate body 58 in the x-direction.

This movability of the latch 46 in the x-direction within the lock module 56 permits a self-healing function of the locking device 40: if, through manipulation of the locking assembly 42, the latch 46 is transferred from its release position into the latching position without the door 26 being closed at the same time, the locking assembly 42 can be returned to the correct state again by subsequent closure of the door. During such a subsequent closing operation, the closing pin 36 comes into contact with the jaw 48 of the latch 46 and thereby displaces the latch 46 sideways in the x-direction until the closing pin 36 is able to pass the jaw 48 and enter the latch mouth 52. This sideways evading movement of the jaw 48 is achieved by a corresponding displacement of the bearing pin 62 in the bearing recess 60. By contrast, as the latch 46 moves between the release position and the latching position, it performs substantially only a rotational movement about a vertical axis of rotation defined by the bearing pin 62; a movement of the bearing pin 62 in the x-direction in the bearing recess 60 does not occur or occurs at most to only a small degree as the latch 46 moves between the release position and the latching position.

The lock housing 42 has guiding systems by means of which the plate body 58 (or the lock module 56 generally) is guided on the lock housing 52 with play movability in the x-direction. The guiding systems comprise a guide web 64 (see, for example, FIG. 2*a*) and an outside wall portion 66 of the lock housing 42 arranged at a distance from the guide ridge 64 in the y-direction. The torsion spring 54 rests on the plate body 58 with one of its spring legs (at 68 in FIG. 2*a*) and rests on the latch 46 with its other spring leg (at 70 in FIG. 2*a*).

The lock housing 44 has in its outside wall a housing opening 72 through which the closing pin 36 enters the locking assembly 42 as the door 26 closes. Behind the housing opening 72 in the y-direction there is formed in the plate body 58 a guide slot 74 which extends in the y-direction and is open in the region of its slot end facing the housing opening 72. In the region of this open slot end, the guide slot merges into an entry funnel 76 with, for example, conically tapering funnel walls. The guide slot 74 has a slot width, measured in the x-direction, which corresponds substantially to the dimension of the closing pin 36 in the x-direction, so that the closing pin 36 is substantially free of play in the x-direction in the guide slot 74.

The guide slot 74 and the entry funnel 76 form an aligning system which allows the lock module 56 to be aligned in the x-direction relative to the closing pin 36 as the door closes. In practice, mounting tolerances of the door 26 on the main machine body 12 or/and of the closing pin 36 on the door 26 can have the result that the x-position of the closing pin 36 relative to the main machine body 12 varies from machine to machine. For example, position tolerances of the closing pin 36 of up to 3 mm or even more relative to the main machine body 12 can easily occur in practice. In order nevertheless to ensure reliable operation of the locking assembly 42, the lock module 56 is mounted in the lock housing 44 "floatingly", as it were, namely with play movability in the x-direction. As the door 26 closes, the entry funnel 76 effects automatic alignment of the lock module 56 in the x-direction relative to the closing pin 36, so that the closing pin 36 is able to enter the guide slot 74. The latch 46 does not change its relative position with respect to the plate body 58 during this compensating movement of the lock module 56 in the x-direction. The relative position of the entry funnel 76 and of the jaw 48 of the latch 46 in the y-direction is such that the alignment of the lock module 56 in the x-direction due to the cooperation of the closing pin 36 with the entry funnel 76 is complete before the closing pin 36, as the door 26 closes, reaches the region of the jaw 48 and passes it. This ensures that, irrespective of any mounting tolerances, the latch 46 is always reliably able to engage with its jaw 48 behind the closing pin 36 as the door closes.

The locking assembly 42 additionally comprises an electric switch 78 which serves to detect whether the door 26 is open or closed. The switch 78 can be actuated by means of a two-armed actuating lever 80 pivotably mounted on the lock housing 44. A first lever arm 82 of the actuating lever 80 cooperates with an actuating nose projecting from a switch housing of the switch 78. The other lever arm, designated 84, of the actuating lever 80 cooperates indirectly or directly with the closing pin 36 so that, as the door 26 closes, that is to say when the closing pin 36 enters the guide slot 74 and is caught in the latch mouth 52 of the latch 46, a pivot movement is induced in the actuating lever 80, which leads to the switch 78 being switched over. There is direct cooperation of the closing pin 36 with the lever arm 84 when the closing pin 36 is in direct contact with the lever arm 84. There is indirect cooperation, on the other hand, when the closing pin 36 comes into contact only with the latch 46 and presses it against the lever arm 84.

The electric switch 78 and the actuating lever 80 do not belong to the lock module 56, that is to say they are arranged inside the lock housing 44 without movement play in the x-direction. A helical compression spring shown at 86 serves to bias the actuating lever 80 in the direction towards the pivot position that it assumes when the door 26 is open.

Figure 2A:
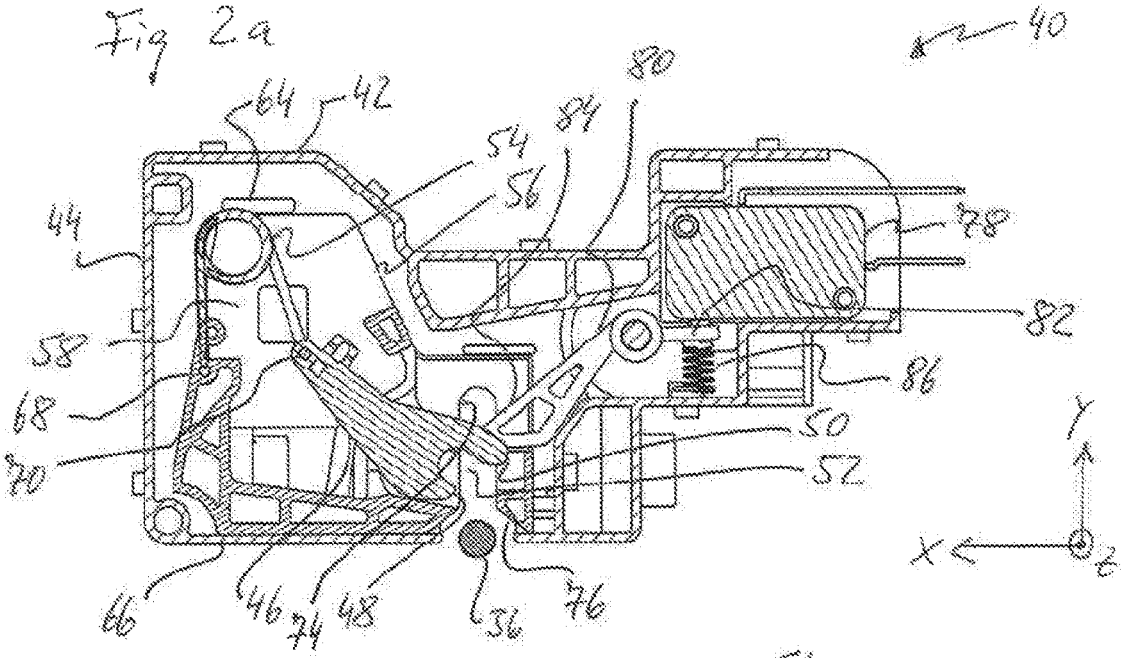
FIGS. 2*a*, 2*b* are views of a locking device from two opposite vertical directions according to a first embodiment, wherein the figures show a situation in which the door is open, or not yet closed.
Figure 2B:
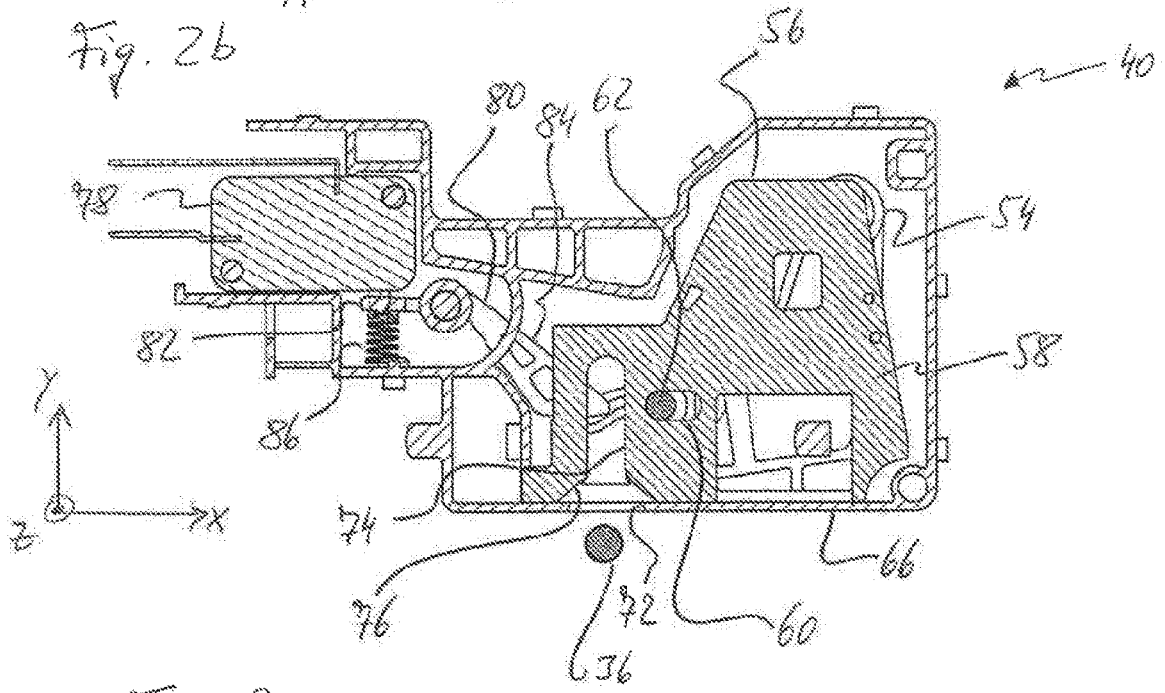
Figure 2C:
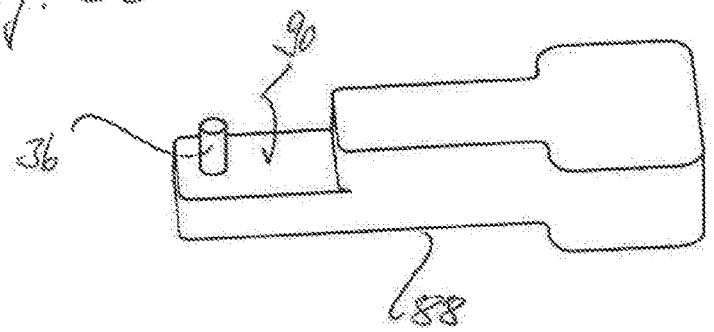
FIG. 2*c* shows, in perspective, an example of a closing body having a closing pin for mounting on the door of a dishwashing machine.
Figure 2D:
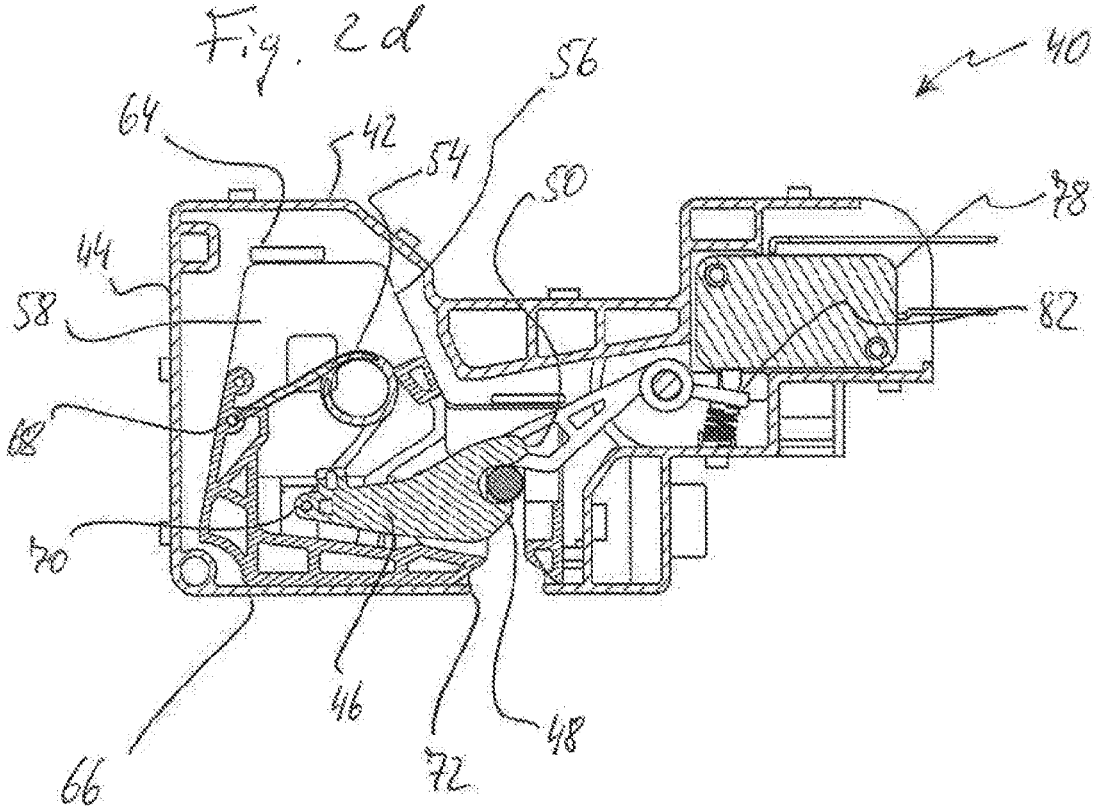
FIGS. 2*d*, 2*e* are views of the locking device of FIGS. 2*a*, 2*b* in a situation in which the dishwasher door is closed.
Figure 2E:
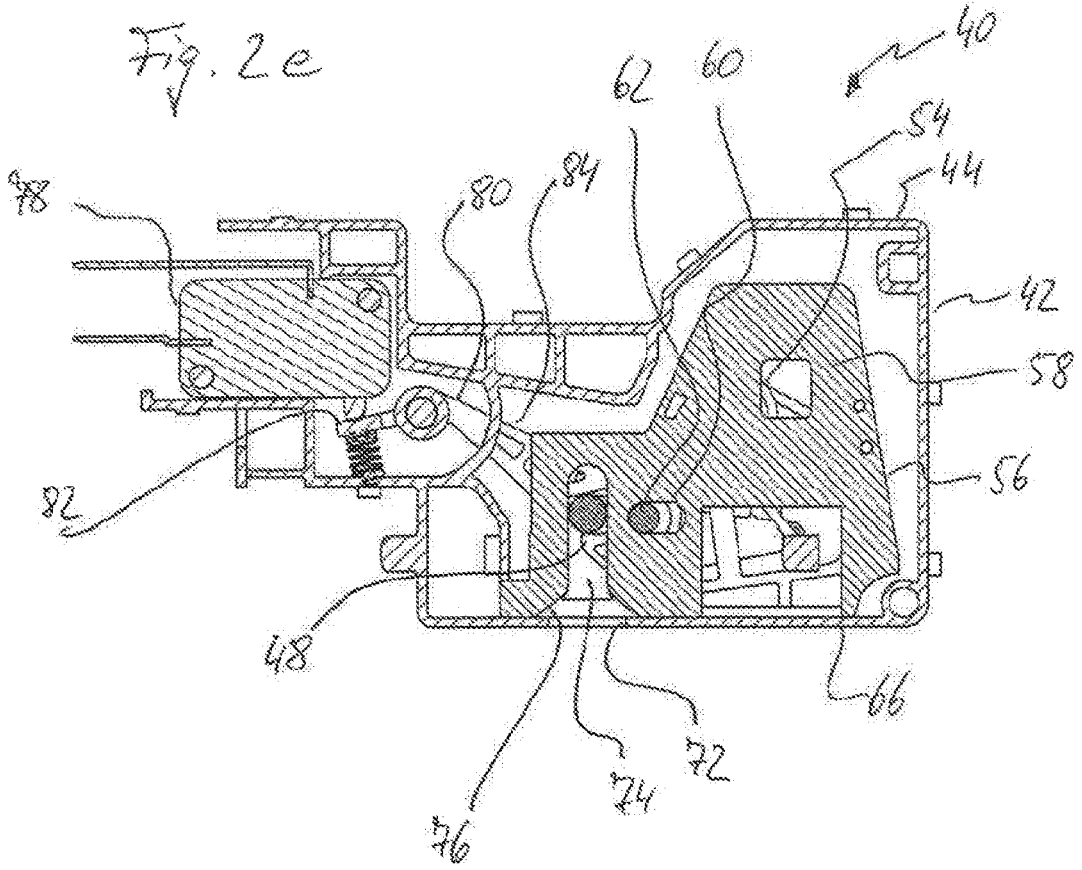
Figure 2F:
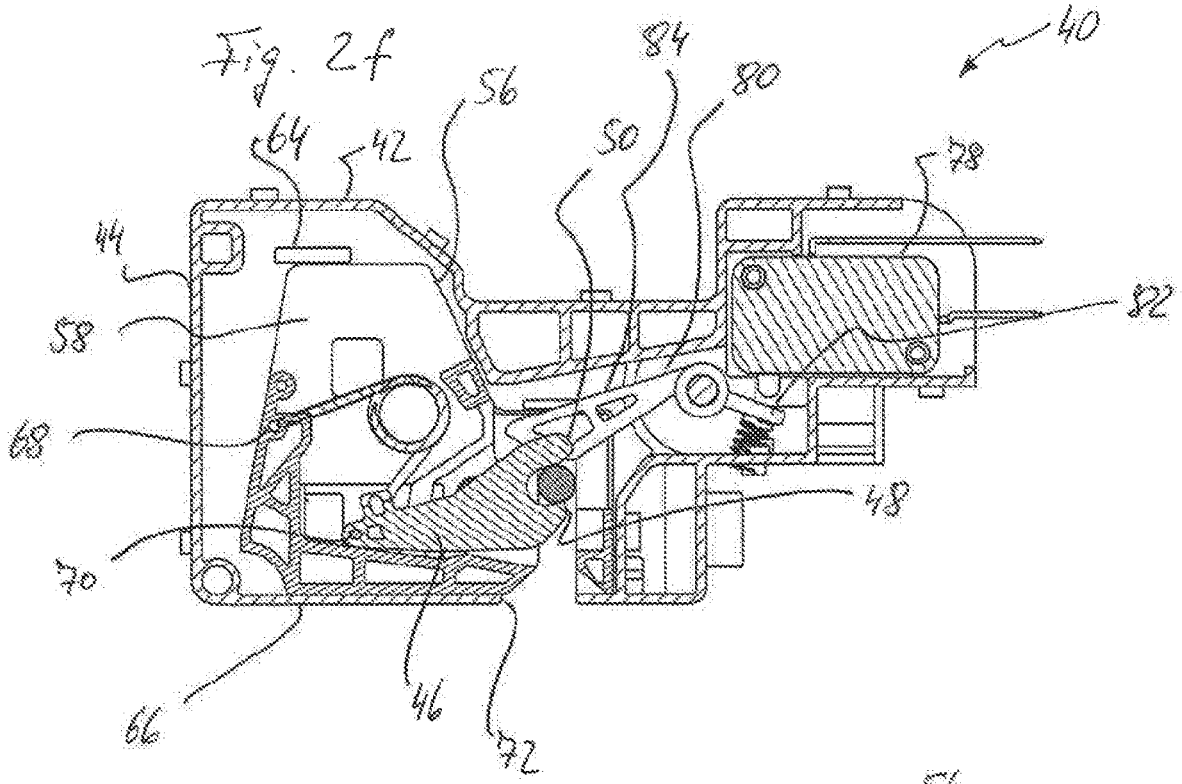
FIGS. 2*f*, 2*g* are views of the locking device of FIGS. 2*a*, 2*b* in a situation in which the dishwasher door is closed, wherein the horizontal-lateral compensation of mounting tolerances of a closing pin of the locking device is shown.
Figure 2G:
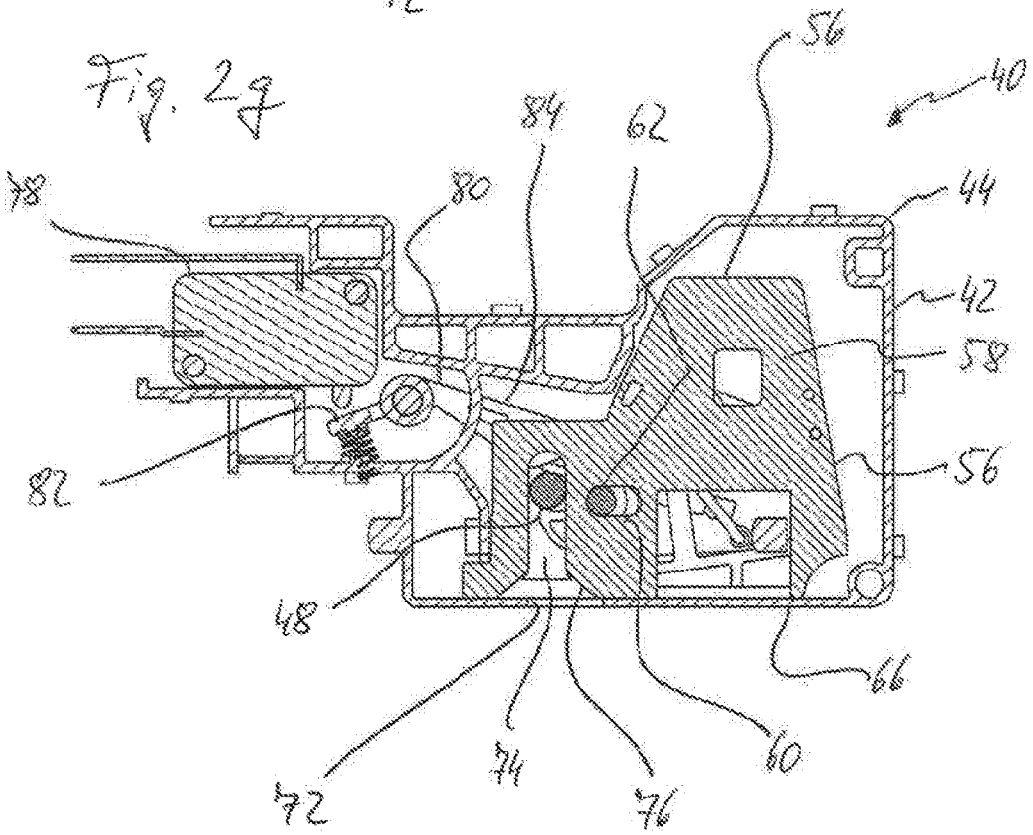

FIGS. 2*d* and 2*e* are views of the locking device 40 according to FIGS. 2*a*, 2*b*, but after the door has been closed. The changed rotary position of the latch 46, in which the jaw 48 is engaged behind the closing pin 36, and the closing pin 36 is thus prevented from moving out of the latch mouth 52 of the latch 46, will be seen. FIGS. 2*f* and 2*g* are also views of the locking device 40 according to FIGS. 2*a*, 2*b*, again with the door 26 closed. However, in FIGS. 2*f*, 2*g*, the latch module 56 has been displaced in the x-direction inside the lock housing 44 (as a result of a compensating movement), as compared with the situation according to FIGS. 2*d*, 2*e*.

As is shown in FIG. 2*c*, the closing pin 36 can be part of a closing body 88 which is fitted in a manner not shown in detail into the door 26 of the dishwashing machine 10 and provides a flat pin-supporting surface 90 on which the closing pin 36 stands with one of its pin ends. The other pin end of the closing pin 36 is free. At least the region of the pin-supporting surface 90 that forms the closing body 88 is formed, for example, by a plate component made of sheet material. The length of the closing pin 36 is, for example, in a range between 6 and 12 mm. In the example shown, the closing pin 36 is in the form of a round rod, that is to say with a circular cross-section. Its diameter is in a range between 4 and 8 mm, for example. It will be appreciated that the invention is not limited to a circular cross-section of the closing pin 36; other cross-sectional geometries are likewise conceivable for the closing pin 36, for example a triangular shape with preferably rounded corner regions.

Reference will now be made to the second embodiment according to FIGS. 3*a* to 3*d*. In these figures, the same components or components having the same action are provided with the same reference numerals as in the preceding figures, but with the addition of a lower case letter. Unless indicated otherwise hereinbelow, reference is made to the preceding observations relating to FIGS. 1 to 2*g* for an explanation of the components in question.

In the embodiment of FIGS. 3*a* to 3*d*, the latch module 56*a* is not mounted in the lock housing 44*a* so as to be movable linearly in a floating manner, but is movable in rotation about an axis of rotation that is fixed relative to the lock housing 44*a*. This axis of rotation is formed by a bearing pin 92*a* which is fixedly connected to the lock housing 44*a*. The rotational play of the lock module 56*a* is play in an xy plane, that is to say in a horizontal plane, in the situation in which the locking device 40*a* is fitted in the dishwashing machine.

The lock module 56*a* comprises a module housing 94*a* on which the latch 46*a* is arranged. The module housing 94*a* includes two plate parts 58*a* (compensating plates), which are arranged one above the other at a distance in the z-direction and each form a guide slot 74*a* with an entry funnel 76*a* in front for the closing pin 36*a*. The latch 46*a* is accommodated between the two plate parts 58*a* of the module housing 94*a*. When the latch 46*a* moves from its release position shown in FIG. 3*b* into the latching position shown in FIG. 3*c*, it performs not only a rotational movement but in addition a movement with a y-component, by means of which there is achieved a pulling effect, which actively pulls the door of the dishwashing machine. In the release position (FIG. 3*b*), the latch 46*a* rests on an abutment face 96*a* formed by the module housing 94*a*, the latch 46*a* resting on the abutment face 96*a* with a supporting nose 98*a*. In the second embodiment according to FIGS. 3*a* to 3*d*, the spring element 54*a* is formed by a helical compression spring which biases the latch 46*a* in the direction towards its latching position. In the release position, the spring element 54*a* is under a greater bias, the engagement of the supporting nose 98*a* with the abutment face 96*a* preventing the spring element 94*a* from relaxing.

The spring element 54*a* rests between the latch 46*a* and a bearing block 100*a* seated on the bearing pin 92*a*. When the closing pin 36*a* comes into contact with the jaw 50*a* of the latch 46*a* as the dishwasher door closes, a torque is introduced into the latch 46*a*, which effects rotation (through a comparatively small angular distance) of the latch 46*a* relative to the module housing 94*a* about the axis of rotation defined by the bearing pin 92*a*. During this rotation, the supporting nose 98*a* comes out of engagement with the abutment face 96*a*, so that the spring element 54*a* is able to relax. In the course of this relaxation, the latch 46*a* moves backwards inside the module housing 94*a* in the y-direction, until the bearing block 100*a* abuts an abutment web 102*a* of the latch 46*a*. This situation is shown in FIG. 3*c*.

Figure 3A:
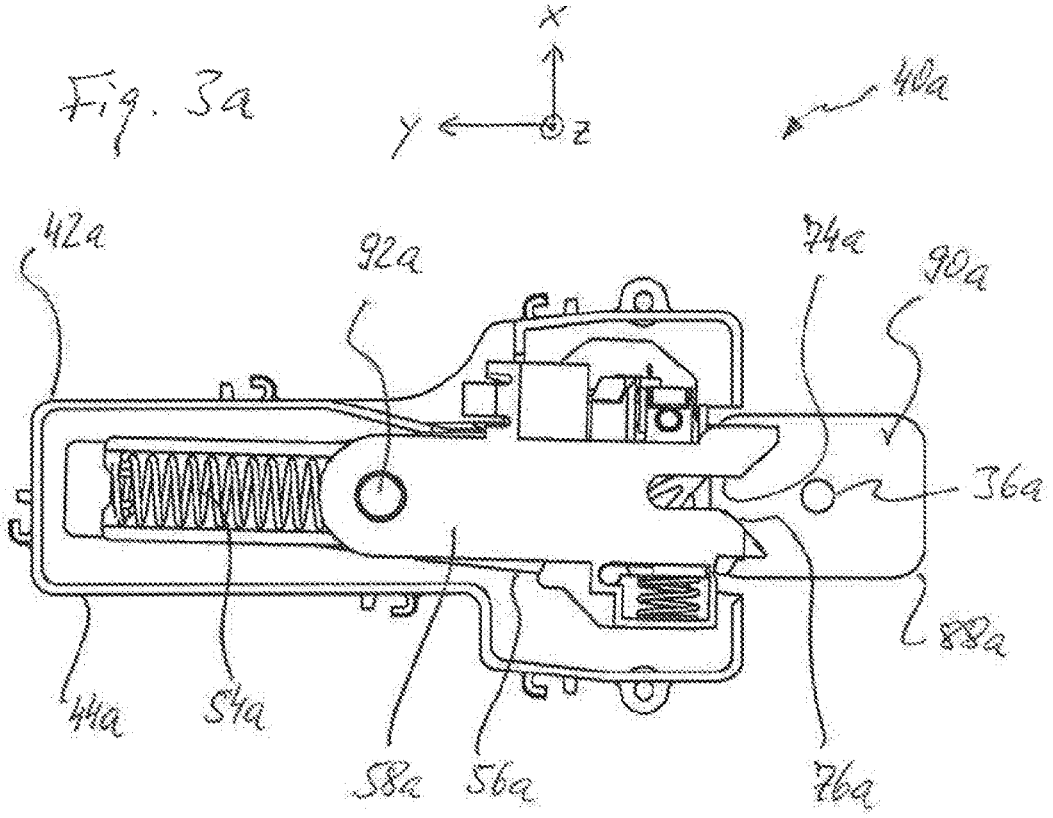
FIG. 3*a* shows a locking device according to a second embodiment in a situation in which the dishwasher door is open, or not yet closed.
Figure 3B:
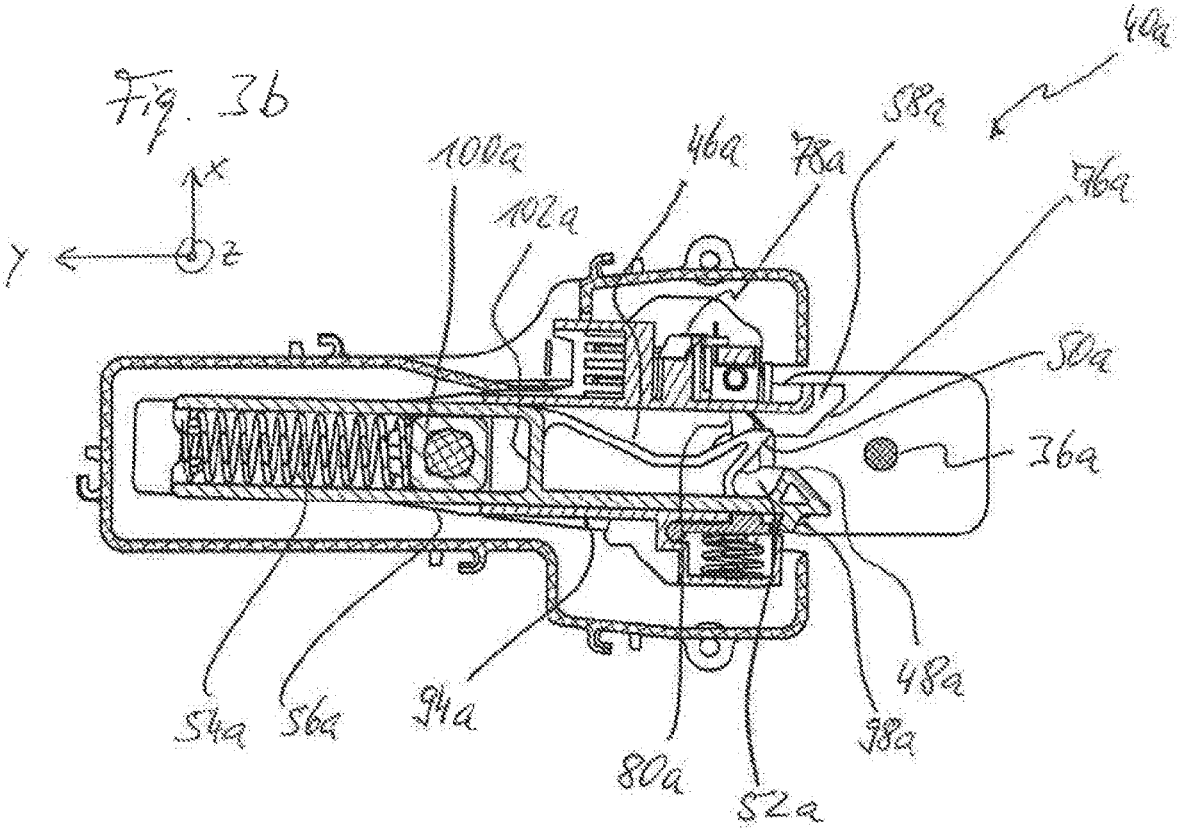
FIG. 3*b* shows the locking device of FIG. 3*a* with omission of a compensating plate, again in a situation in which the dishwasher door is open, or not yet closed.
Figure 3C:
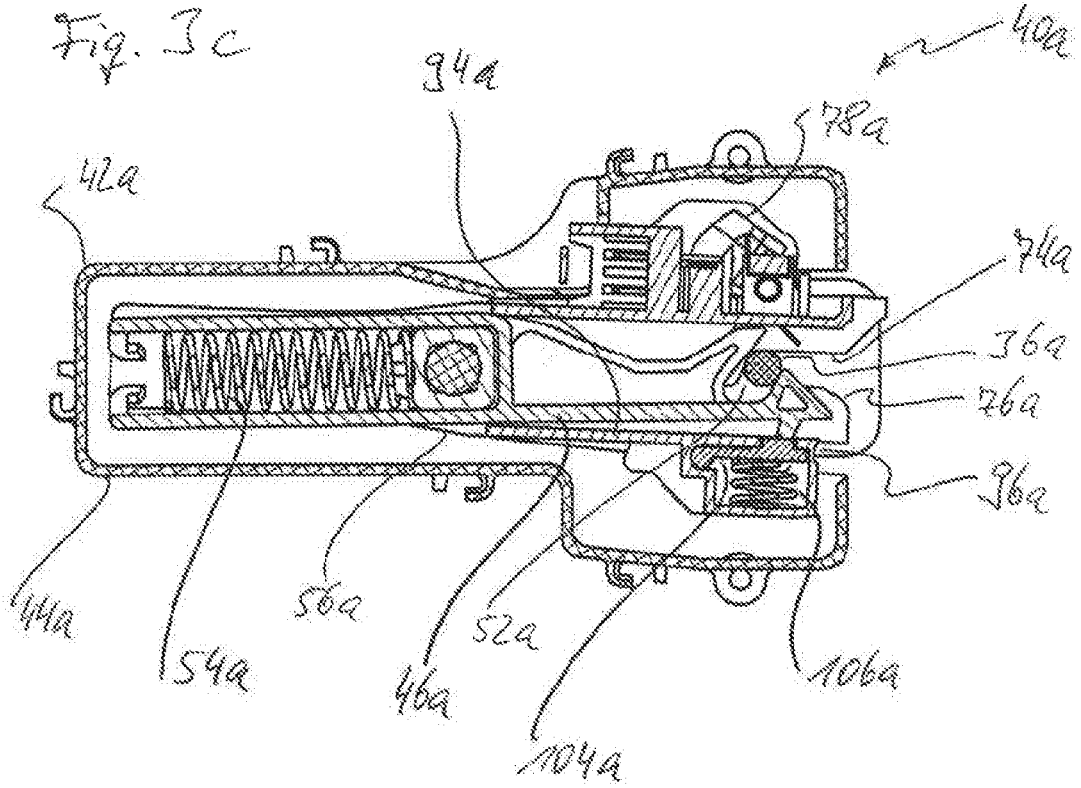
FIG. 3*c* shows the locking devices of FIGS. 3*a*, 3*b*, but in a situation in which the dishwasher door is closed.
Figure 3D:
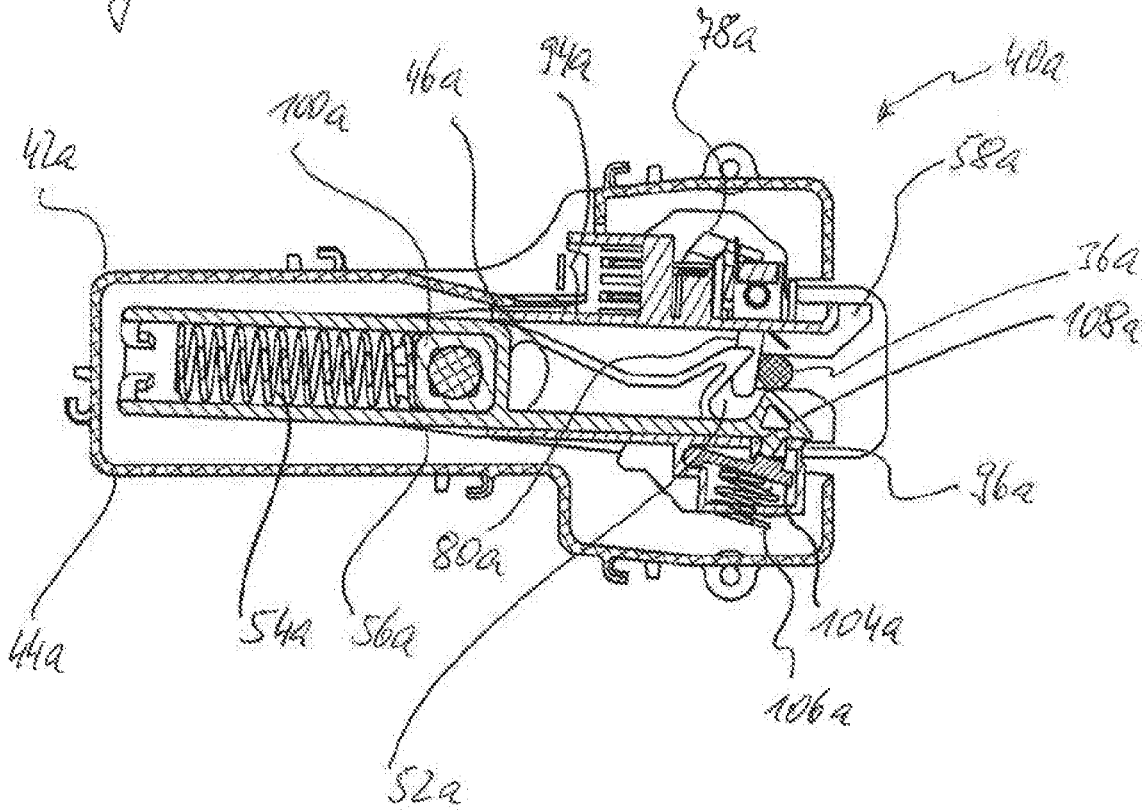
FIG. 3*d* shows a self-healing state of the locking device of FIGS. 3*a*, 3*b*.

In the latching position of the latch 46*a* according to FIG. 3*c*, the supporting nose 98*a* is situated above a self-healing element 104*a* which is acted upon by a bias spring 106*a* and, in a normal state, closes a self-healing opening 108*a* formed in the module housing 94*a*. The force of the bias spring 106*a* is sufficiently great to withstand any angular momentum which can act upon the latch 46*a* when, with the door closed (that is to say, in the situation according to FIG. 3*c*), the door is pulled with the aim of opening the door. The flank of the jaw 48*a* facing the closing pin 36*a* is sufficiently steep that, in the case of such a pulling action on the closing pin 36*a* and consequently on the latch 46*a*, the torque it generates on the latch 46*a* is not sufficient to overcome the resistance of the bias spring 106*a* and push the self-healing element 104*a* out of its position closing the self-healing opening 108*a*.

The self-healing element 104*a* performs its function when, without closing the door, the latch 46*a* has moved into its latching position according to FIG. 3*a*, for example by manipulation with a screwdriver or another elongate object which has been introduced into the latch assembly 42*a*. If the door of the dishwashing machine is closed in this situation, the closing pin 36*a* presses on the flank of the jaw 48*a* that is further away from the latch mouth 52*a*. This flank runs flatter with respect to the y-direction than does the flank of the jaw 48*a* facing the latch mouth 52*a*. The force exerted on the door therefore generates a greater torque on the latch 46*a*, which is sufficient to deflect the self-healing element 104*a* against the action of the bias spring 106*a*. The self-healing opening 108*a* is thereby freed, and the supporting nose 98*a* of the latch 46*a* can engage therein. The closing pin 36*a* is then able to move past the jaw 48*a* and into the latch mouth 52*a*.

As in the first embodiment according to FIGS. 2*a* to 2*g*, an electric switch 78*a* which serves to detect whether the door of the dishwashing machine is open or closed is also provided in the second embodiment according to FIGS. 3*a* to 3*d*. In contrast to the first embodiment, the switch 78*a* in the second embodiment is part of the lock module 56*a*, that is to say when the lock module 56*a* performs (rotational) compensating movements, the switch 78*a* moves with it. The switch 78*a* can be actuated by an actuating lever 80*a* which, like the actuating lever 80 of the first embodiment, has two arms. The actuating lever 80*a* can again be actuated either directly by the closing pin 36*a* or indirectly by way of the latch 46*a*.

Figure 4A:
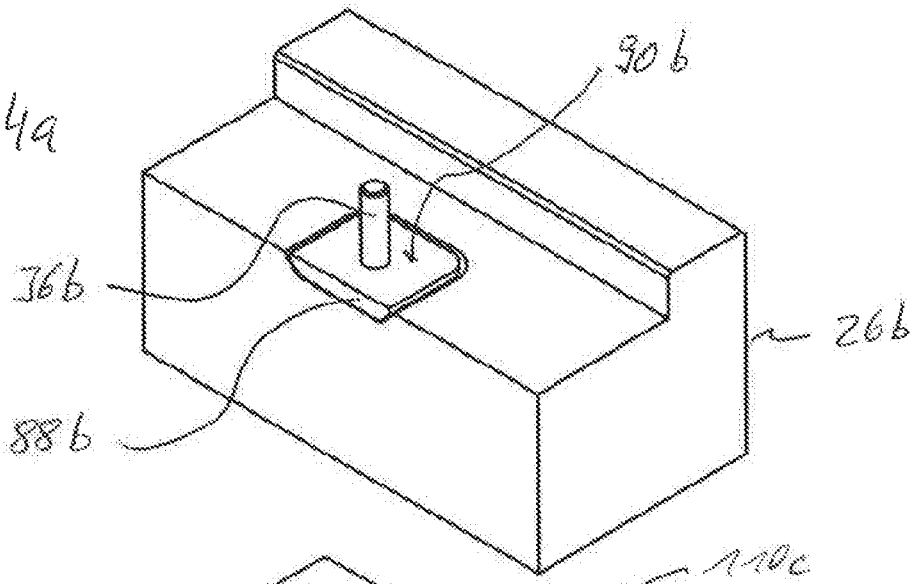
FIGS. 4*a* to 4*c* show different variants of a closing body fitted in the door of a dishwashing machine.
Figure 4B:
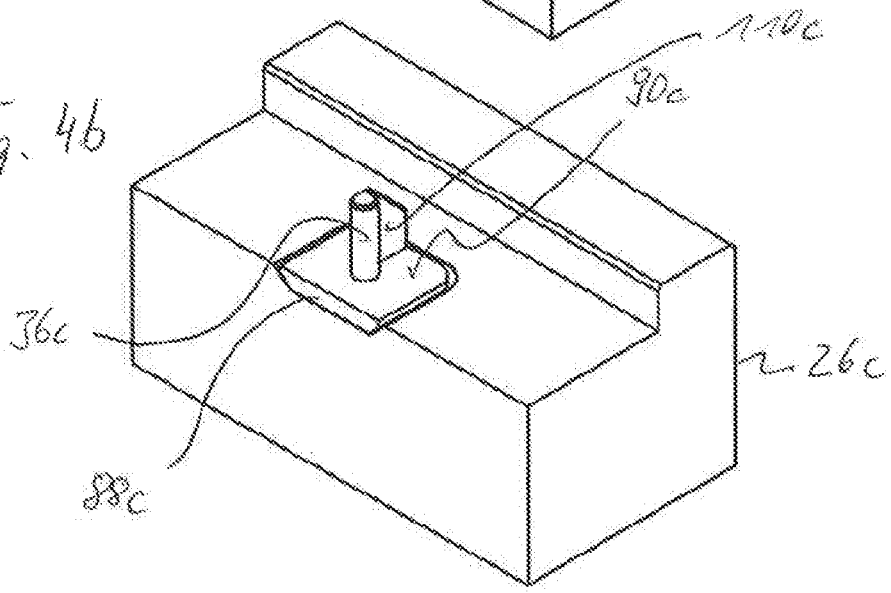
Figure 4C:
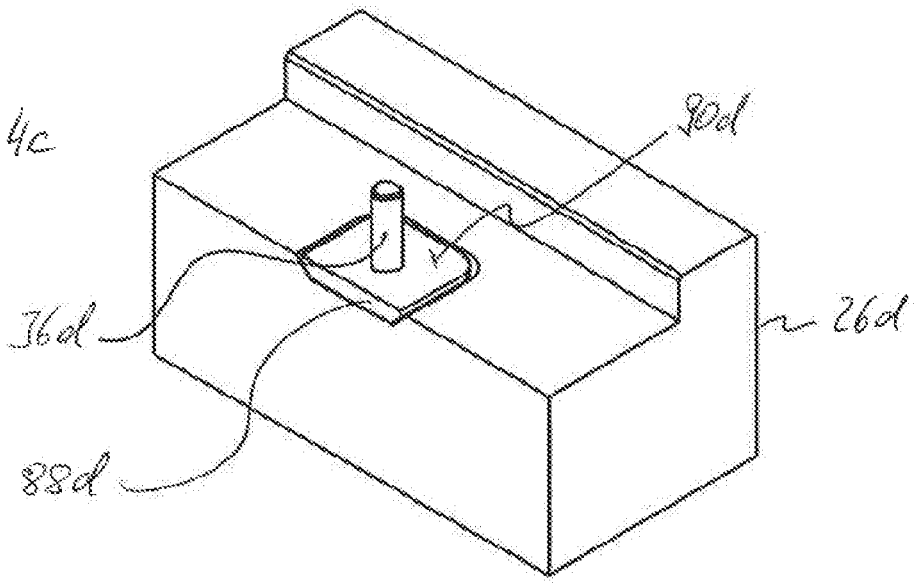

In FIGS. 4*a* to 4*c* too, the same components or components having the same action have been designated by the same reference numerals as previously, a different lower case letter being added to the reference numeral in question in order to distinguish between the different variants. Unless indicated otherwise hereinbelow, reference is again made to the above observations relating to the preceding figures.

In the variant according to FIG. 4*a*, the closing pin 36*b* has a circular cross-section, as does the closing pin 36*c* of the variant according to FIG. 4*b*. In the variant of FIG. 4*c*, on the other hand, the closing pin 36*d* is designed with an approximately triangular cross-section with rounded triangle edges. In the variant of FIG. 4*b*, the closing pin 36*c* is additionally supported by a supporting rib 110*c* on its pin rear side (that is to say the side of the pin that is remote from the locking assembly when the door is closed). In the example shown, the supporting rib 110*c* extends substantially over the entire length of the closing pin 36*c* and—like the closing pin 36*c*—protrudes from the pin-supporting surface 90*c* perpendicularly to that surface. The supporting rib 110*c* is sufficiently thin that it does not prevent the latch contained in the locking assembly from engaging behind the closing pin 36*c*.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A domestic electrical appliance comprising:

a main appliance body having a product treatment chamber;

a door mounted on the main appliance body so as to be pivotable about a horizontal pivot axis that is close to a floor of the main appliance body, for closing an access opening to the product treatment chamber; and a locking device having a locking assembly arranged on the main appliance body and a closing pin arranged on the door, wherein the locking assembly comprises a latch which is arranged to be movable between a release position and a latching position, which latch, in the latching position, engages behind the closing pin in order to hold the door closed and, in the release position, releases the closing pin to open the door, wherein the latch performs a rotational movement along a horizontal plane as it moves between the release position and the latching position, and the closing pin is oriented vertically when the door is closed, wherein there is formed on the locking assembly an aligning system for the mutual horizontal-lateral alignment of the closing pin and the latch, which aligning system cooperates with the closing pin as the door closes, wherein the latch and the aligning system are arranged for joint movement with a lock module, and wherein the latch and the aligning system are combined in the lock module which is mounted in a lock housing of the locking assembly with play movability along a horizontal plane.

2. The domestic appliance according to claim 1, wherein the latch has a latch mouth delimited by two jaws, wherein the closing pin comes into contact with a first of the jaws as the door closes and thereby initiates a movement of the latch from the release position into the latching position, and wherein, in the course of that movement of the latch, a second of the jaws of the latch moves behind the closing pin.

3. The domestic appliance according to claim 1 wherein the aligning system comprises a guide slot which the closing pin enters as the door closes.

4. The domestic appliance according to claim 3, wherein the closing pin is substantially free of horizontal-lateral movement play in the guide slot.

5. The domestic appliance according to claim 3, wherein an entry funnel is arranged in front of the guide slot in the region of one of its slot ends closer to the closing pin.

6. The domestic appliance according to claim 1, wherein the play movability of the lock module includes rotational movability about an axis of rotation that is fixed relative to the lock housing, or linear movability relative to the lock housing.

7. The domestic appliance according to claim 1, wherein the play movability of the lock module is intended to compensate for horizontal-lateral position tolerances of the closing pin selected from the group consisting of at least 1.5 mm, at least 2 mm, at least 2.5 mm, and at least 3 mm.

8. The domestic appliance according to claim 1, wherein the lock module further comprises one of a spring arrangement for spring-biasing the latch, an electric switch that responds to the closing and opening of the door, or both.

9. A domestic electrical appliance comprising:

a main appliance body having a product treatment chamber;

a door for closing an access opening to the product treatment chamber; and a locking device having a locking assembly arranged on one of two appliance components, the appliance components being the main appliance body and the door, and having a closing body arranged on the other of the two appliance components, wherein the locking assembly comprises a latch which is arranged to be movable between a release position and a latching position, which latch, in the latching position, engages behind the closing body in order to hold the door closed and, in the release position, releases the closing body to open the door, wherein there is formed on the locking assembly an aligning system for the mutual alignment of the closing body and the latch, which aligning system cooperates with the closing body as the door closes, wherein the latch and the aligning system are combined in a lock module which is mounted with play movability relative to a lock housing of the locking assembly.

* * * * *